US007530535B2

(12) United States Patent
Fox

(10) Patent No.: US 7,530,535 B2
(45) Date of Patent: May 12, 2009

(54) RAILWAY TRACK SWITCH

(76) Inventor: David K. Fox, 440 W. Ferndale Rd., Wayzata, MN (US) 55391

( * ) Notice: Subject to any disclaimer, the term of this patent is extended or adjusted under 35 U.S.C. 154(b) by 110 days.

(21) Appl. No.: 11/521,081

(22) Filed: Sep. 13, 2006

(65) Prior Publication Data

US 2007/0080263 A1 Apr. 12, 2007

Related U.S. Application Data

(60) Provisional application No. 60/716,766, filed on Sep. 13, 2005.

(51) Int. Cl.
*E01B 7/00* (2006.01)

(52) U.S. Cl. ..... 246/452; 246/453; 246/415 R

(58) Field of Classification Search ..... 246/393, 246/415 R, 430, 431, 435 R, 442, 448, 449, 246/450, 451, 452, 453, 476
See application file for complete search history.

(56) References Cited

U.S. PATENT DOCUMENTS

| | | | | | |
|---|---|---|---|---|---|
| 71,807 | A | | 12/1867 | Staats | |
| 248,990 | A | * | 11/1881 | Brahn | 246/321 |
| 1,348,729 | A | * | 8/1920 | Myers | 246/337 |
| 1,430,952 | A | * | 10/1922 | Crossley | 246/318 |
| 1,802,875 | A | | 4/1931 | Conley | |
| 2,651,714 | A | * | 9/1953 | Poole | 246/253 |
| 4,093,163 | A | | 6/1978 | Larsson | |
| 4,105,175 | A | | 8/1978 | De Spiegeleer | |
| 4,890,804 | A | | 1/1990 | Teramoto et al. | |
| 5,562,267 | A | | 10/1996 | Heim et al. | |
| 5,620,156 | A | | 4/1997 | Berggren et al. | |
| 5,622,340 | A | | 4/1997 | Turner et al. | |
| 6,158,698 | A | | 12/2000 | Click et al. | |
| 6,290,189 | B1 | | 9/2001 | Heim | |
| 6,511,024 | B1 | | 1/2003 | Bonfigli | |
| 6,543,727 | B2 | | 4/2003 | Click et al. | |
| 2004/0227037 | A1 | | 11/2004 | Schwiede et al. | |

OTHER PUBLICATIONS

International Search Report and Written Opinion mailed Jun. 26, 2008.

* cited by examiner

*Primary Examiner*—Mark T Le
(74) *Attorney, Agent, or Firm*—Merchant & Gould P.C.

(57) ABSTRACT

A railroad switch point having fixed rails and switching rails is provided. The switch point includes a first railroad tie having a top side. The switch point also includes a rod positioned at the top side of the first railroad tie. The rod is coupled to the switching rails and is also coupled to a switch actuator. A first rail support is secured to the top side of the first railroad tie for supporting the fixed rails and the switching rails above the rod.

20 Claims, 11 Drawing Sheets

RAILWAY TRACK SWITCH

This application claims priority from provisional application Ser. No. 60/716,766, filed Sep. 13, 2005, and which is incorporated herein by reference.

TECHNICAL

The present invention relates generally to railway track equipment. More particularly, the present invention relates to railway track switches.

BACKGROUND

Conventional railroad tracks include rails supported on railroad ties. The railroad ties are supported on an aggregate bed that functions as a foundation for the ties. Routine track maintenance involves the periodic tamping of the aggregate bed to ensure that the bed is sufficiently compacted to provide adequate support to the rails and ties. Tamping is a fairly straightforward procedure on most lengths of track. However, at switch points, tamping can be more difficult because the various switching linkages typically positioned between the rails prevent the tamping equipment from accessing the aggregate bed located beneath the linkages. To overcome the above problem, it has been proposed to place a track switching mechanism within a hollow railroad tie (see U.S. Pat. No. 4,105,175 to De Spiegeleer). However, this type of design is fairly complicated and the relatively large, open volume within the railroad tie provides areas where ice and debris can collect thereby interfering with the effective operation of the switching arrangement. In view of the above problems, an improved switching device for railroad tracks is needed.

SUMMARY

One aspect of the present disclosure relates to a railroad track switching device that is relatively simple and that allows the aggregate adjacent to the switch point to be readily tamped with minimal interference from the switching device.

Examples representative of a variety of inventive aspects are set forth in the description that follows. The inventive aspects relate to individual features as well as combinations of features. It is to be understood that both the forgoing general description and the following detailed description merely provide examples of how the inventive aspects may be put into practice, and are not intended to limit the broad spirit and scope of the inventive aspects.

DETAILED DESCRIPTION

In general, one aspect of the present disclosure relates to a railroad switch having one or more switching linkages mounted within a plate positioned at the top side of a railroad tie. In certain embodiments, the plate can define a channel or other type of guide structure for guiding the linkage along a path of travel (e.g., a linear path of travel). Another general aspect of the present disclosure relates to a railroad track switching device having a switch linkage including a non-electrically conductive composition. In one embodiment, the entire linkage is made of a dielectric material such as plastic. In other embodiments, the linkage can have a composite structure. For example, the linkage may include a conductive (e.g., metal such as steel) core surrounded by a dielectric layer (e.g., a dielectric housing or coating).

Figure 1A:
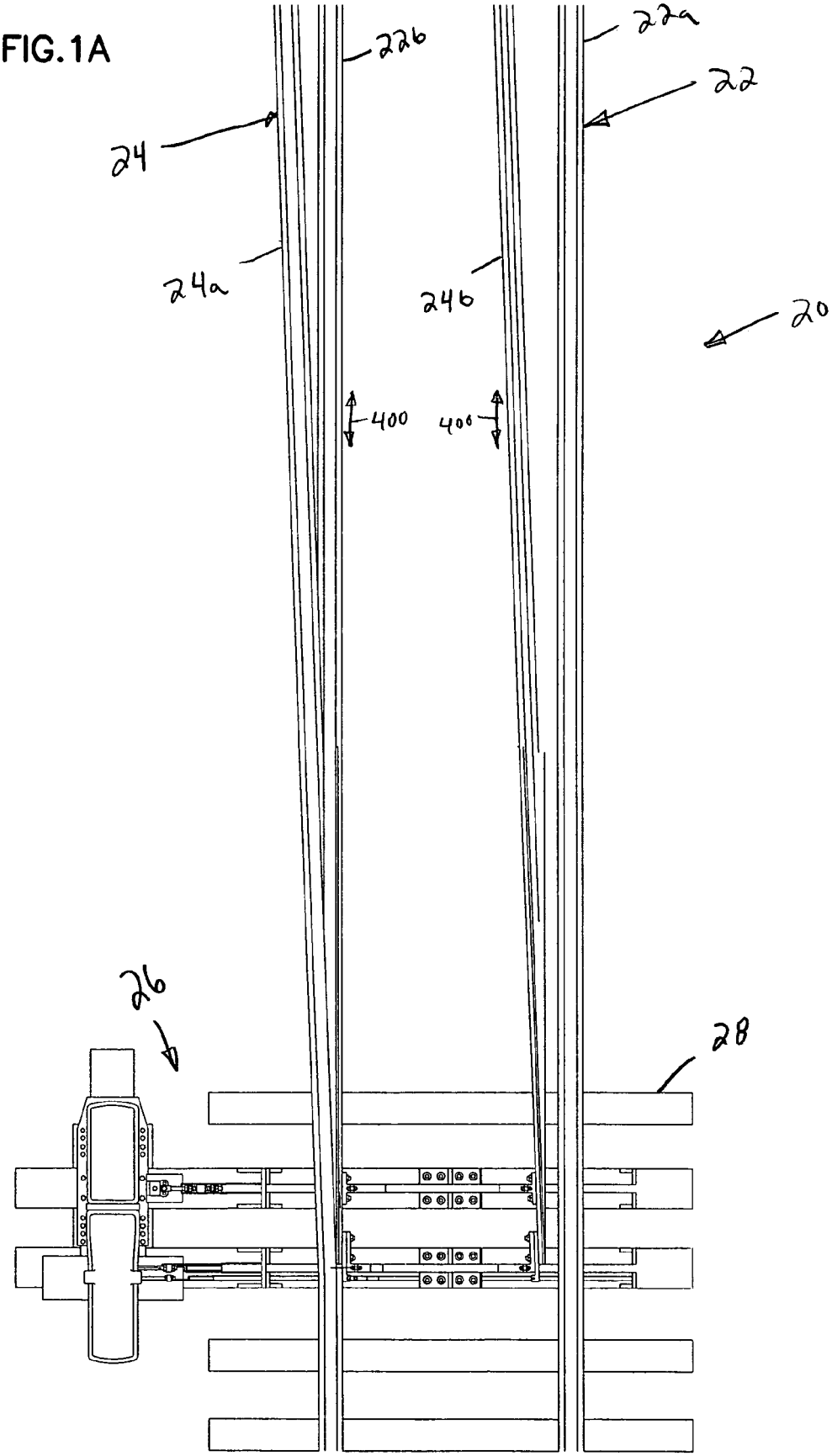
FIG. 1A is a top plan view of a railroad switch point in accordance with the principles of the present disclosure, the switch point is switched to a first position where trains are routed along a main track.
Figure 1B:
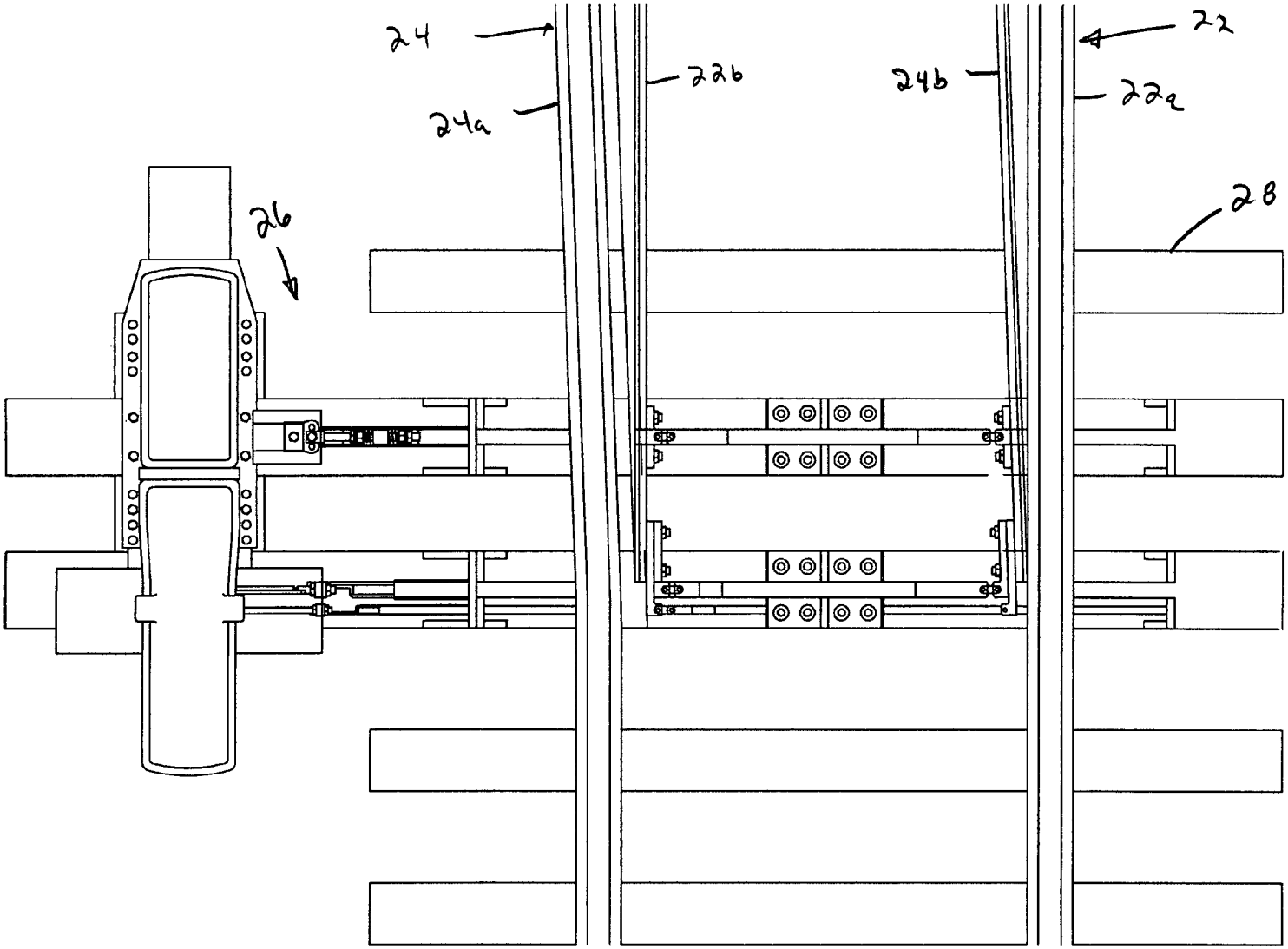
FIG. 1B shows the switch point of FIG. 1A switched to a second position where trains are routed to a side track.

FIGS. 1A and 1B show a railroad track arrangement 20 in accordance with the principles of the present disclosure. The track arrangement 20 includes a main track 22 and a side track 24. The main track 22 includes a fixed rail 22*a* and a switch rail 22*b*, and the side track 24 includes a fixed rail 24*a* and a switch rail 24*b*. A switching mechanism 26 is located at a switch point of the track arrangement 20. The switching mechanism 26 moves the switching rails 22*b*, 24*b* between a first position (shown at FIG. 1A) and a second position (shown at FIG. 1B). In the position of FIG. 1A, the switch point routes trains along the main track 22. In the position of FIG. 1B, the switch point routes trains along the side track 24.

Referring still to FIGS. 1A and 1B, the rails 22*a*, 22*b*, 24*a* and 24*b* are supported on railroad ties 28. For clarity, only a few of the ties 28 are shown. The railroad ties 28 are typically supported on an aggregate base. Typically, the railroad ties 28 have a wood construction. In one embodiment, the railroad ties 28 have a square 9 inch by 9 inch cross-sectional shape at the region beneath the rails 22*a*, 22*b*, 24*a*, 24*b*.

Figure 2A:
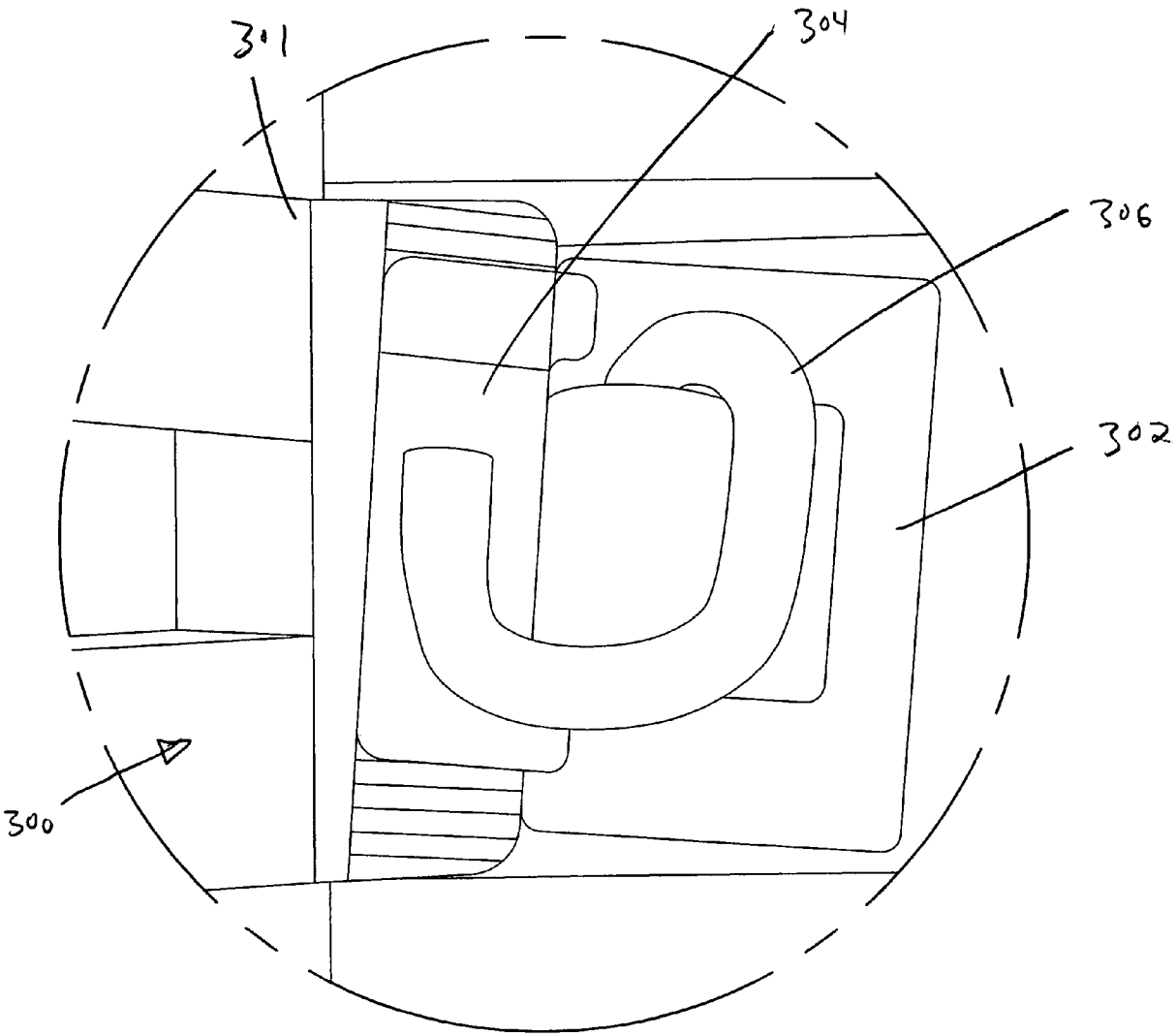
FIGS. 2A and 2B show a conventional rail reinforcement arrangement that can be used with a switch point in accordance with the principles of the present disclosure.
Figure 2B:
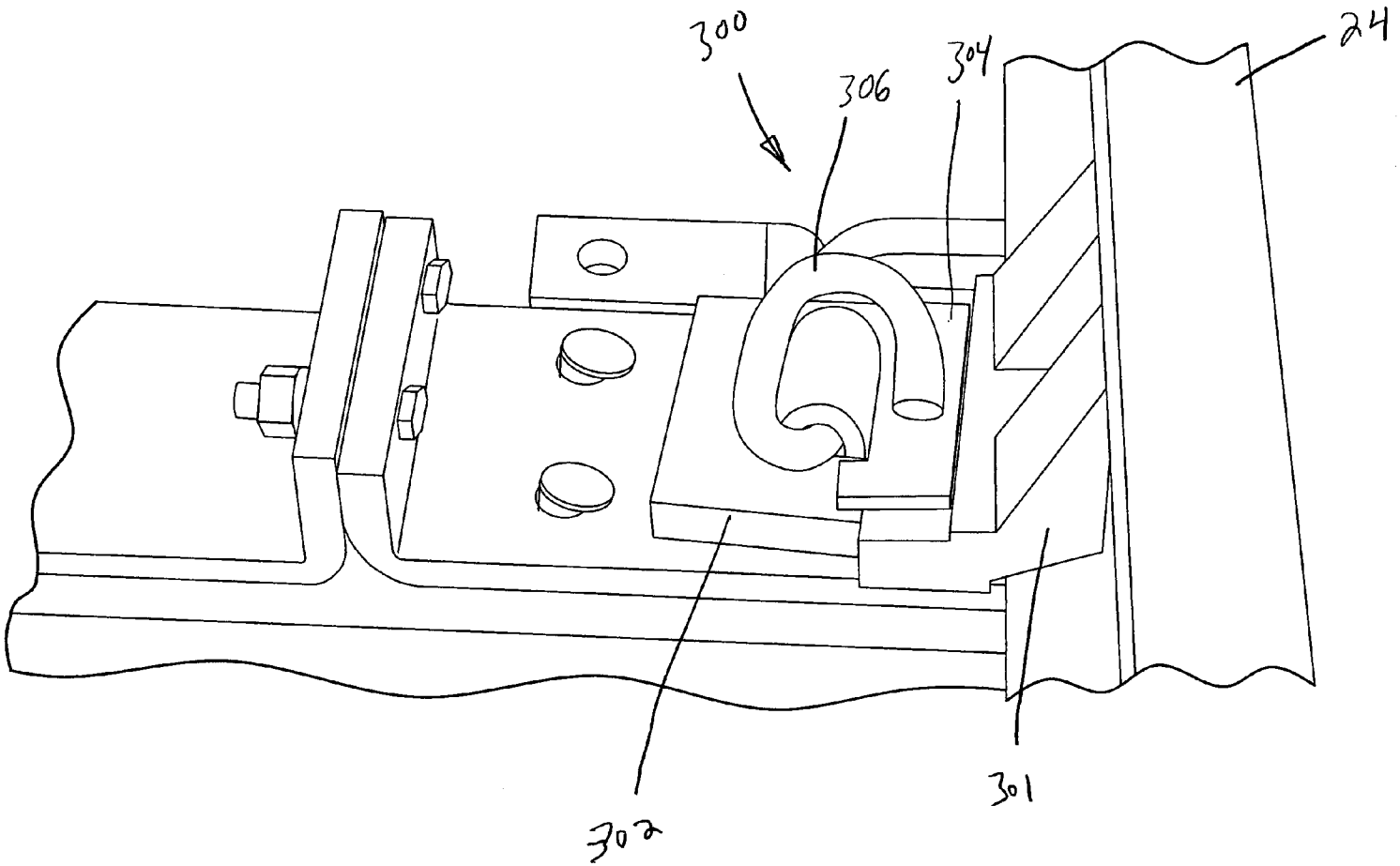
Figure 2:
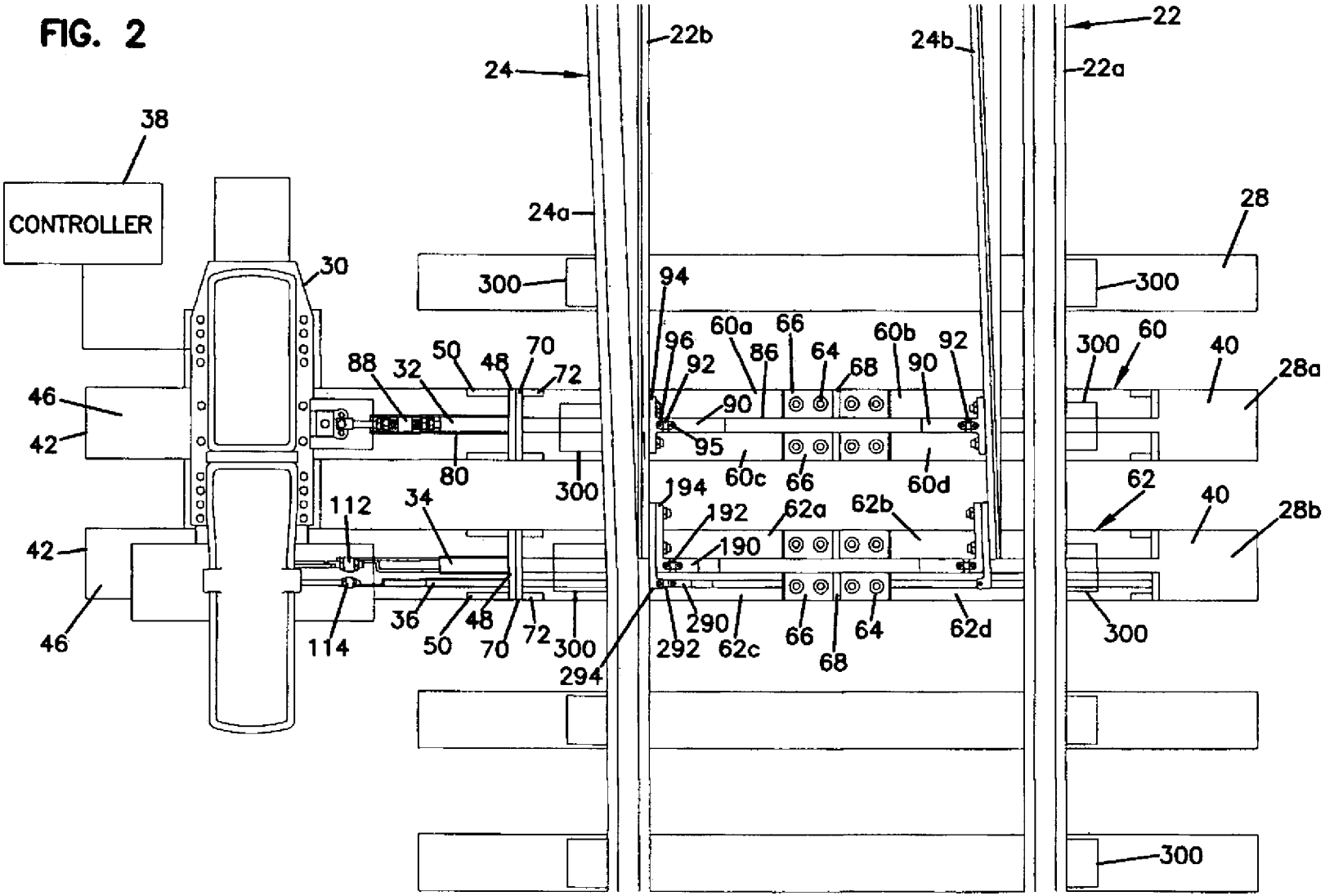
FIG. 2 is an enlarged view of the linkage arrangement of the switch point of FIG. 1.
Figure 2A:
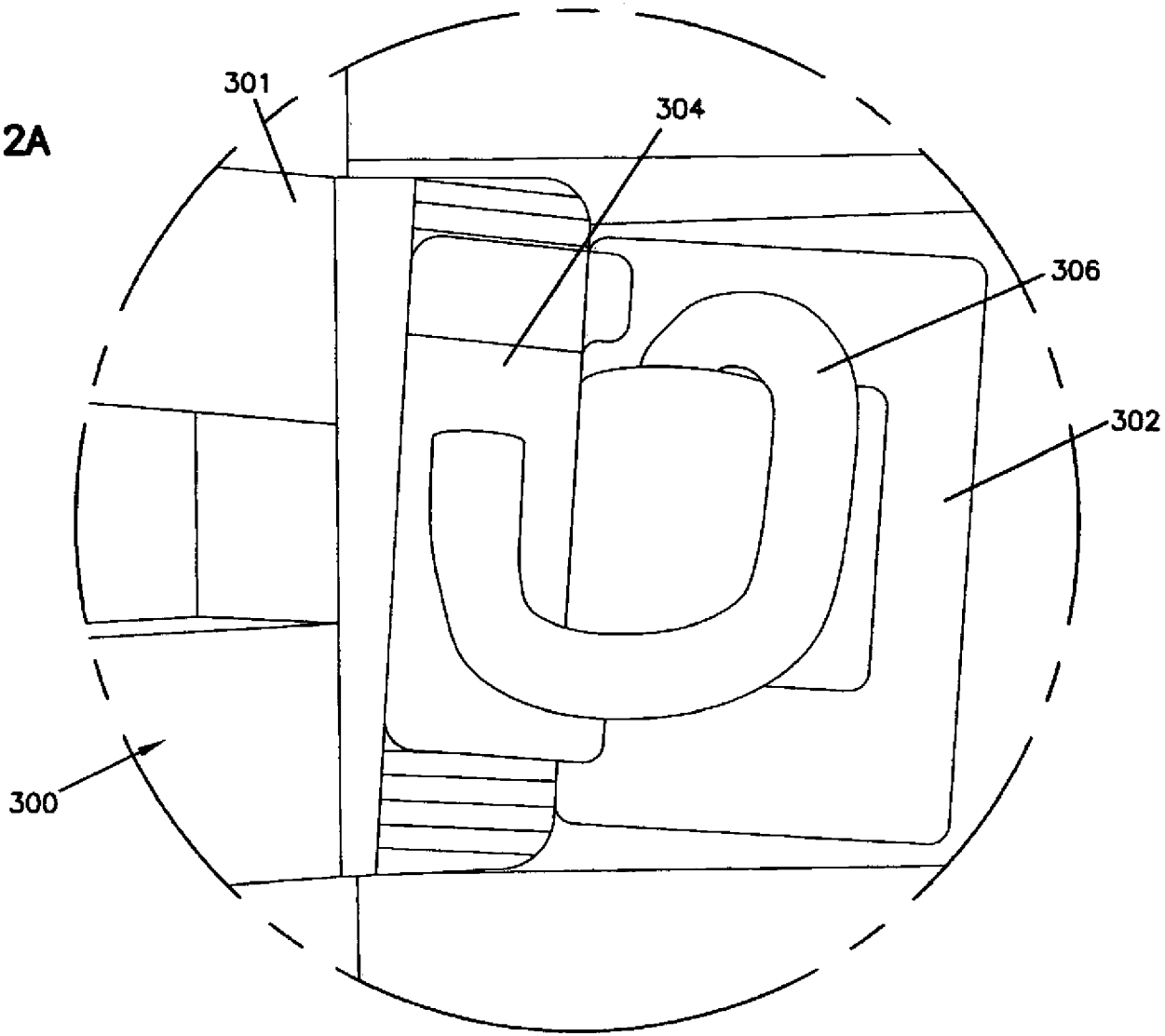
Figure 2B:
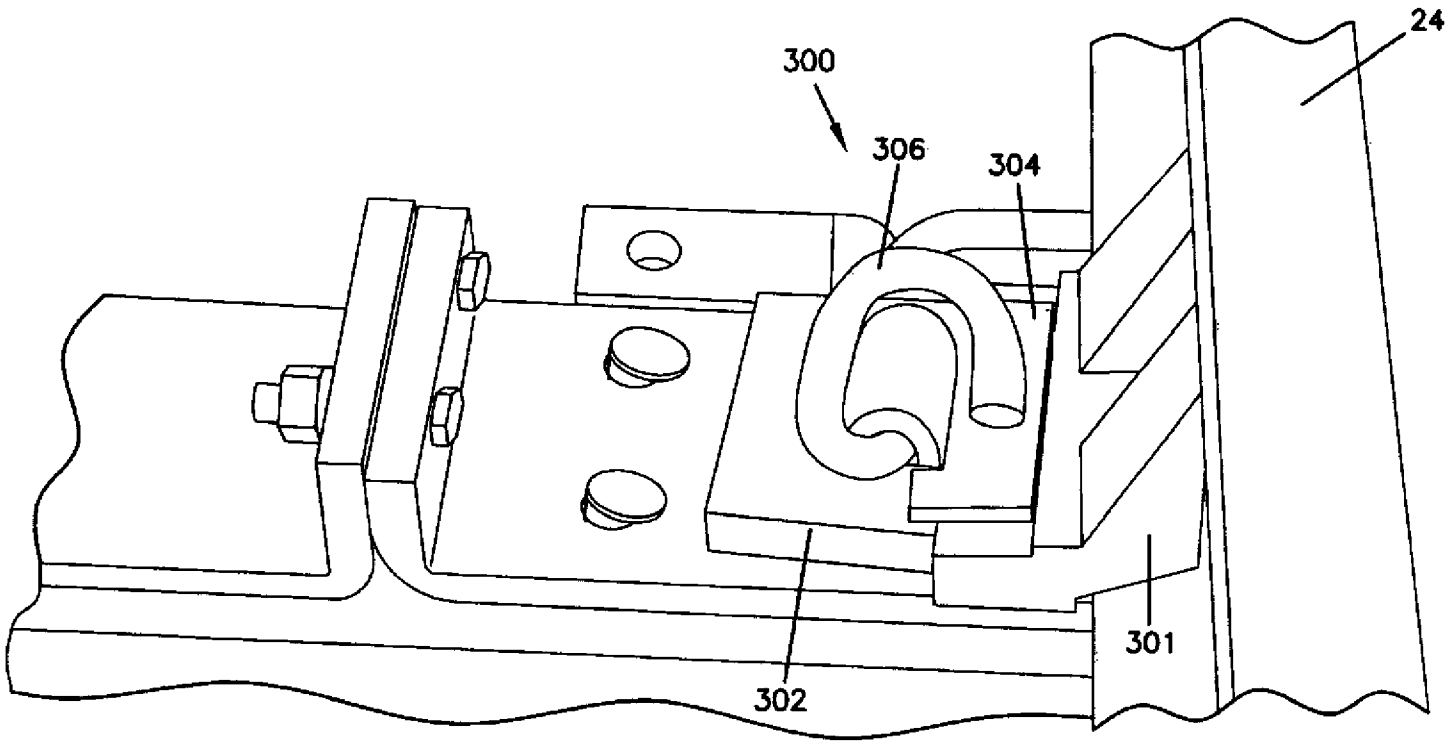
Figure 3:
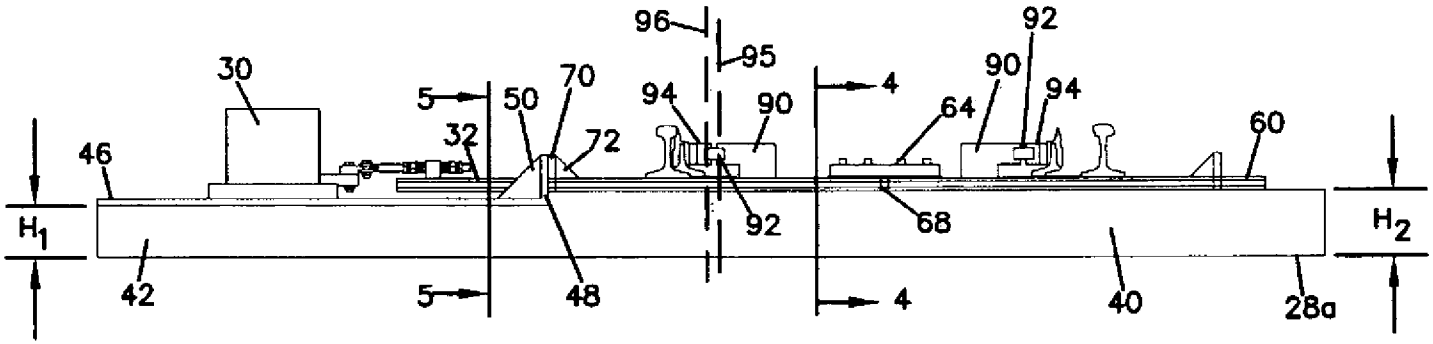
Figure 5:
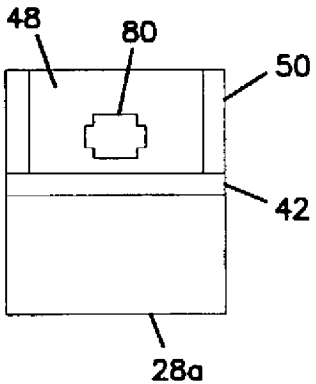
Figure 4A:
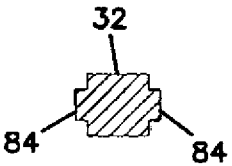
Figure 4:
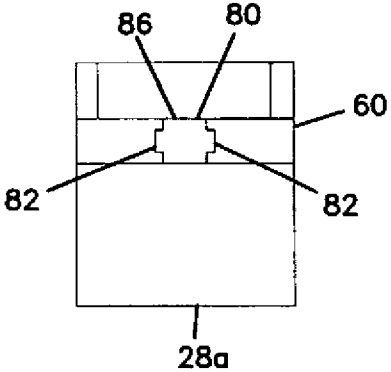
Figure 6:
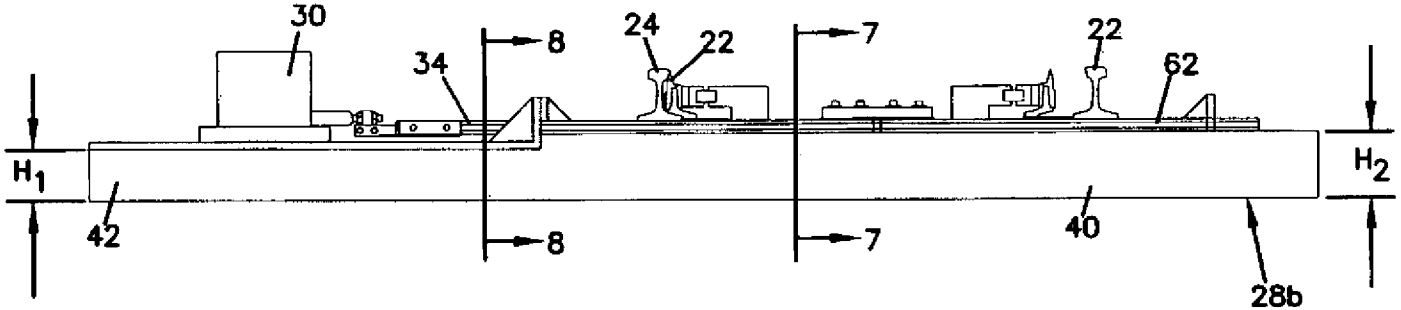
Figure 8:
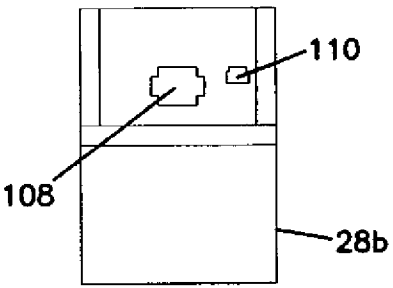
Figure 7:
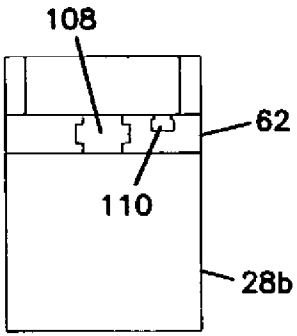
Figure 9:
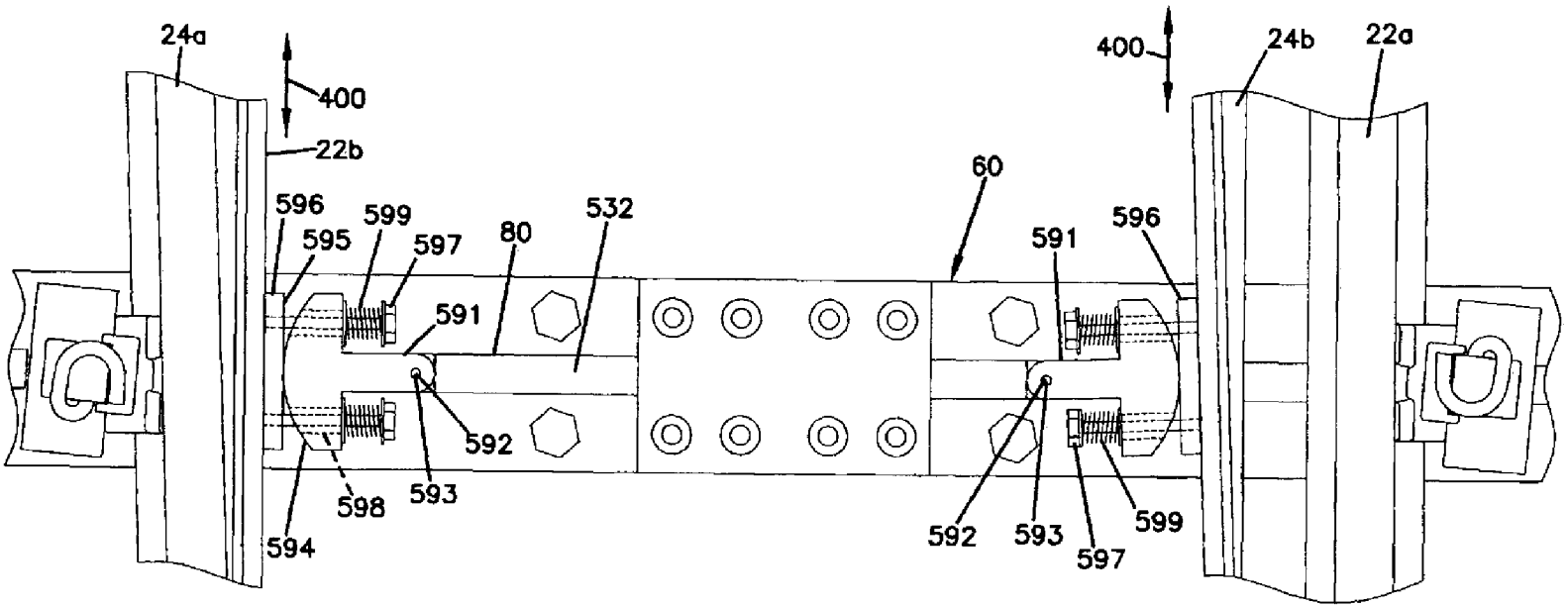
Figure 10:
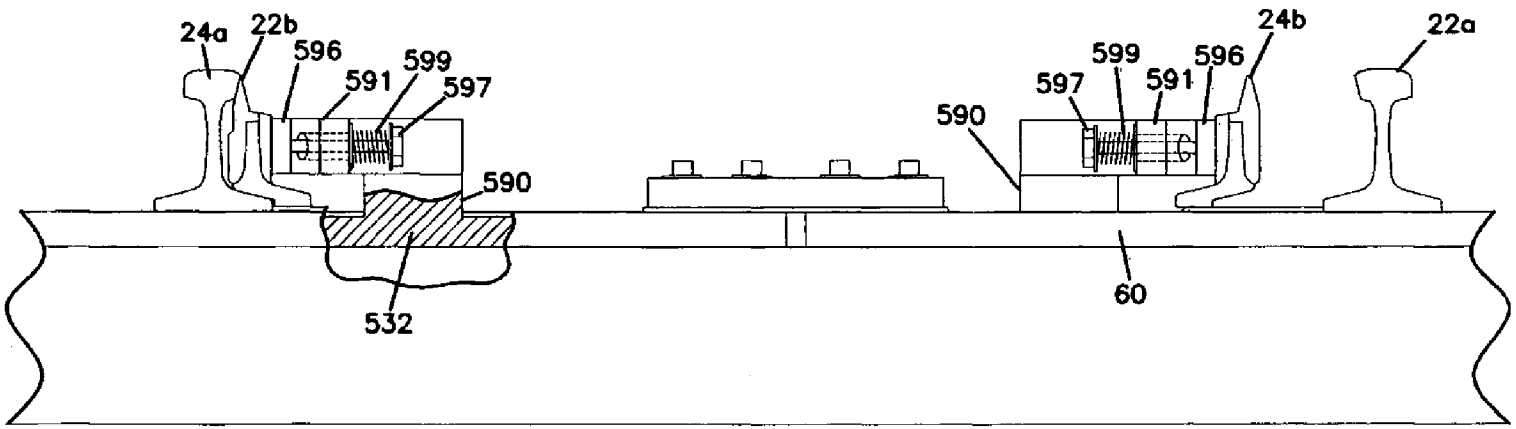
Figure 11:
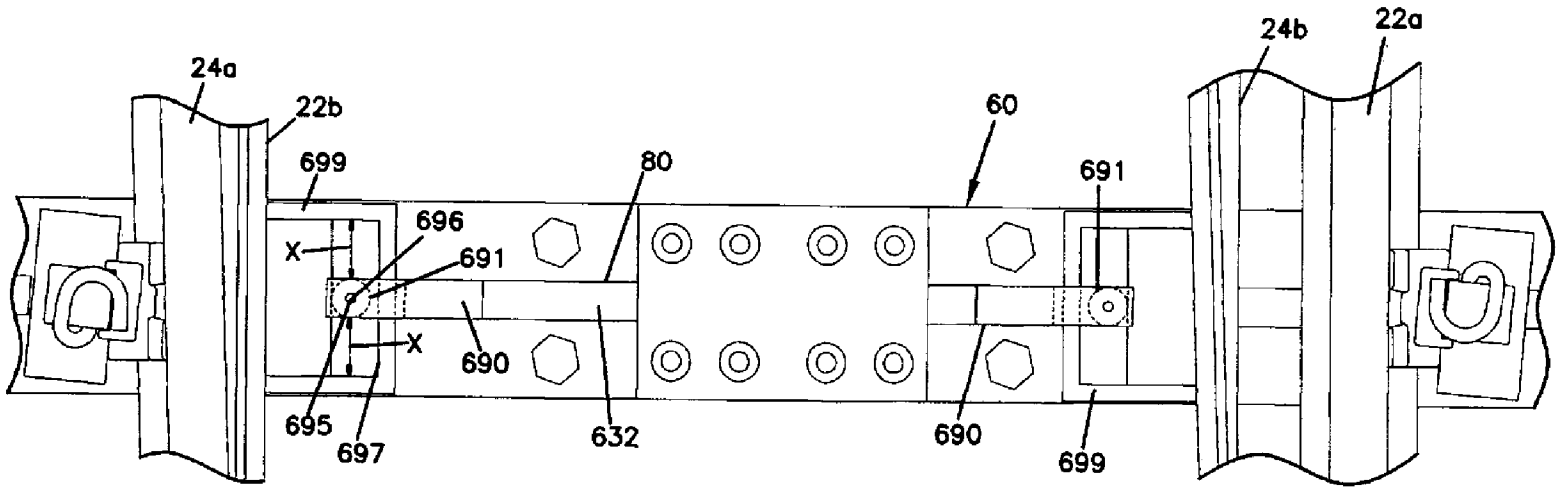
Figure 12:
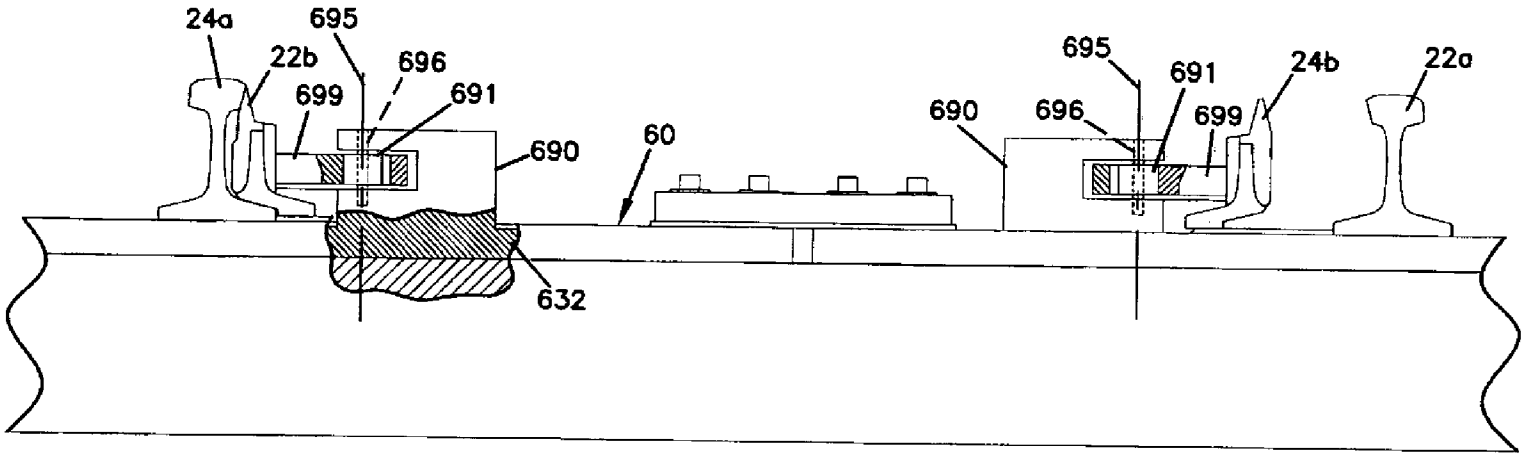

Referring to FIG. 2, the switching mechanism 26 includes an actuator 30 offset to the side of the fixed rail 24*a*.

Referring still to FIG. 2, the actuator 30 interfaces with a throw rod 32, a lock rod 34, and an indication rod 36. The actuator 30 also interfaces with a controller 38 that controls operation of the actuator 30. The actuator 30 pushes the throw rod 32 in a direction away from the actuator 30 to move the switching rails 22*b*, 24*b* from the position of FIG. 1A to the position of FIG. 1B. The actuator 30 pulls the throw rod 32 toward the actuator 30 to move the switching rails 22*b*, 24*a* from the position of FIG. 1B to the position of FIG. 1A. After the switching rails 22*b*, 24*b* have been moved to the desired position, the actuator 30 locks the lock rod 34 in place to prevent unintended movement of the switching rails 22*b*, 24*b*. Prior to switching, the actuator 30 releases the lock rod 34 so that the lock rod does not interfere with the movement of the switching rail 22*b*, 24*b* during switching operations. The indication rod 36 follows the movement of the switching rails 22*b*, 24*b* and interface with electric switches (e.g., limit switches) that provide information to the signal system regarding the position of the switching rails 22*b*, 24*b* so that the position of the switching rails 22*b*, 24*b* can be verified and monitored.

Figure 3:
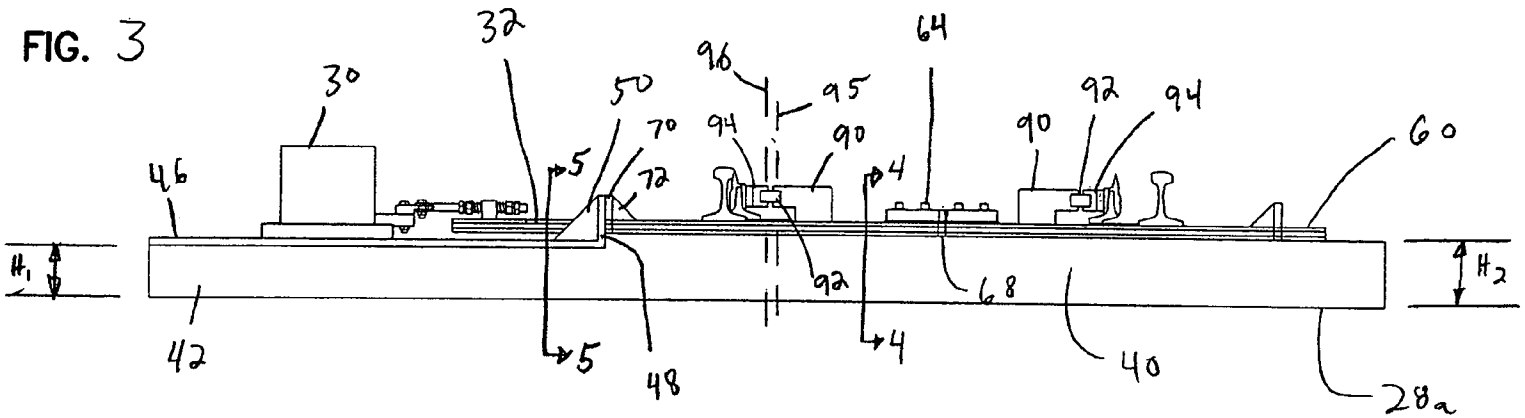
FIG. 3 is a cross-sectional view taken along section line 3-3 of FIG. 2.
Figure 6:
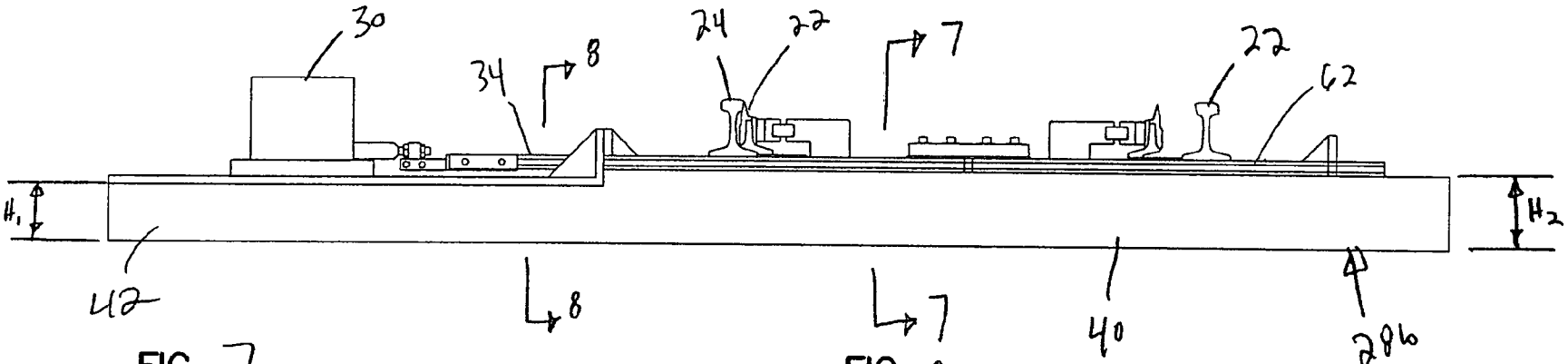
FIG. 6 is a cross-sectional view taken along section line 6-6 of FIG. 2.

Referring still to FIG. 2, the actuator 30 is mounted on railroad ties 28*a*, 28*b*. The railroad ties 28*a*, 28*b* are customized with each having a rail supporting portion 40 positioned beneath the rails and an actuator mounting portion 42 on which the actuator 30 is mounted. The railroad ties 28*a*, 28*b* preferably are manufactured from a conventional material such as wood, but can also be manufactured of other materials such as concrete, steel, wood laminate or other compositions. In one embodiment, the rail supporting portions 40 have conventional 9 by 9 inch cross-sectional shape, while the actuator mounting portions 42 have reduced heights as compared to the rail supporting portions 40. For example, as shown in FIGS. 3 and 6, the actuator mounting portions 42 have heights H1 which are smaller than corresponding heights H2 of the rail supporting portions 40. The actuator 30 is mounted on actuator mounting plates 46 secured to the top sides of the actuator mounting portions 42 of the ties 28*a*, 28*b*. The actuator mounting plates 46 include connector flanges 48 reinforced by gussets 50.

The fixed rails 22*a*, 24*a* are secured to support plates 60, 62 fastened to the top sides of the rail support portions 40 of the railroad ties 28*a*, 28*b*. Support plates 60, 62 are preferably manufactured of a metal material such as steel. In one embodiment, the plates 60, 62 have a thickness of less than 3 inches and most preferably about 2 inches. Plates 60, 62 support the weight of the rails and also define guides or channels for supporting and guiding movement of the throw rod 32, the lock rod 34 and the indication rod 36. Spikes, bolts or other fasteners can be used to secure the plates 60, 62 to the top sides of the ties 28*a*, 28*b*. The fasteners typically will extend through openings in the plates 60, 62. Rail reinforcement assemblies 300 can also be secured (e.g., welded) to the top sides of the plates 60, 62. FIGS. 2A and 2B show an example rail reinforcement assembly 300 including a rail brace 301, a rail brace support plate 302 welded to the top plate of the tie, a locking plate 304 that interlocks with the brace 301 to prevent the brace 301 from sliding relative to the support plate 302, and a clip 306 (e.g., an e-clip) for holding the locking plate 304 down. In use, the brace 301 is wedged between the support plate 302 and the rail (e.g., by hammering the brace in place across the top side of the top tie plate), and then locked in place by plate 304 and clip 306.

Referring to FIG. 2, support plate 60 includes four separate pieces 60*a*-60*c* and support plates 62 includes four separate pieces 62*a*-62*d*. Connector plates 66 and fasteners 64 are used to secure dielectric spacers 68 between pieces 60*a* and 60*b*, between pieces 60*c* and 60*c*, between pieces 62*a* and 62*b*, and between pieces 62*c* and 62*d*. The insulators 68 prevent the support plates 60, 62 from providing electrical connections between the rails of the track arrangement 20. Dielectric spacers can also be used to electrically insulate the connector plates 66 from the top sides of the plates 60, 62 (e.g., the insulators can extend between the connector plates 66 and the top sides of the plates 60, 62). Insulators (e.g., dielectric bushings) can also be used to electrically isolate the fasteners 64 from the connector plates 66. The support plates 60, 62 include connector flanges 70 supported by gussets 72. Fasteners such as bolts can be used to secure the connector flanges 70 of the rail support plates 60, 62 to the flanges 48 of the actuator mounting plate 46. Flanges 70 and gussets 72 can be provided at both ends of the plates 60, 62 to accommodate mounting the actuator 30 on either the left or right side of the tracks.

Figure 5:
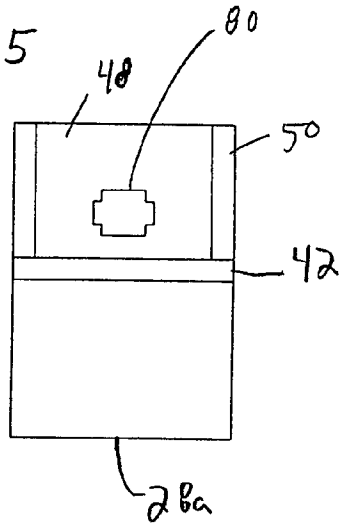
FIG. 5 is a cross-sectional view taken along section line 5-5 of FIG. 3.
Figure 4:
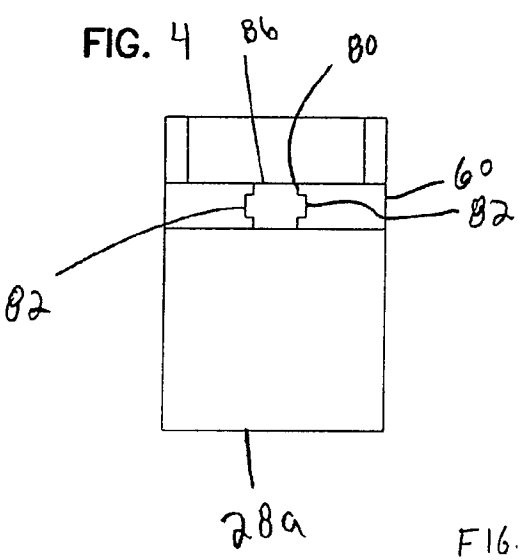
FIG. 4 is a cross-sectional view taken along section line 4-4 of FIG. 3.
Figure 4A:
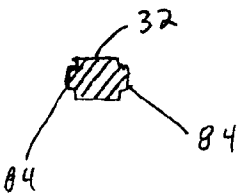
FIG. 4A is a cross-sectional view of a throw-rod in accordance with the principles of the present disclosure.

The support plates 60, 62 are adapted for supporting the weight of the rails, and also for supporting and guiding the throw rod 32. As shown in FIG. 2, the support plate 60 defines a channel 80 that extends along the length of the plate 60 between the rails of the track arrangement 20. The channel 80 is sized to receive the throw rod 32 such that the throw rod 32 can slide back and forth along the length of the channel 80. As shown at FIGS. 4 and 5, the channel 80 includes interior notches 82 that extend along the length of the channel 80. The notches 82 are sized to receive corresponding projections 84 (see FIG. 4A) that extend along a length of the throw rod 32. A top side 86 of the channel 80 is open.

The support plates 60, 62 also provide structural reinforcement to the throw rod 32 to prevent the throw rod 32 from excessively bending/flexing during usage. In one embodiment, the support plates 60, 62 contact or are in close proximity to the throw rod 32 for a majority of the length of the throw rod 32. In a preferred embodiment, the plates 60, 62 contact the throw rod 32 for at least substantially the entire distance between the rails 22*b*, 24*b*. By providing the plates 60, 62 in close proximity to or in contact with the throw rod 32, debris is also inhibited from entering the channel between the plates 60, 62.

Referring still to FIG. 2, the throw rod 32 is connected to the actuator 30 by a linkage 88. From the linkage 88, the throw rod 32 extends through the flanges 48, 70 and into the channel 80 defined by the support plate 60. The throw rod 32 includes risers 90 (see FIG. 3) that extend upwardly through the open top side 86 of the channel 80. Pivot links 92 connect the risers 90 to brackets 94 fastened to the switch rails 22*b*, 24*b*. Each of the pivot links 92 includes two vertical pivotal axis 95, 96 defined by pins that connect the links 92 to the risers 90 and the brackets 94, respectively. The pivot links 92 provide a pivoting action that prevents the throw rod 32 from binding within the channel 80 as the throw rod 32 slides along the channel 80 to move the switch rails 22*b*, 24*b* between the two switch positions.

Figure 7:
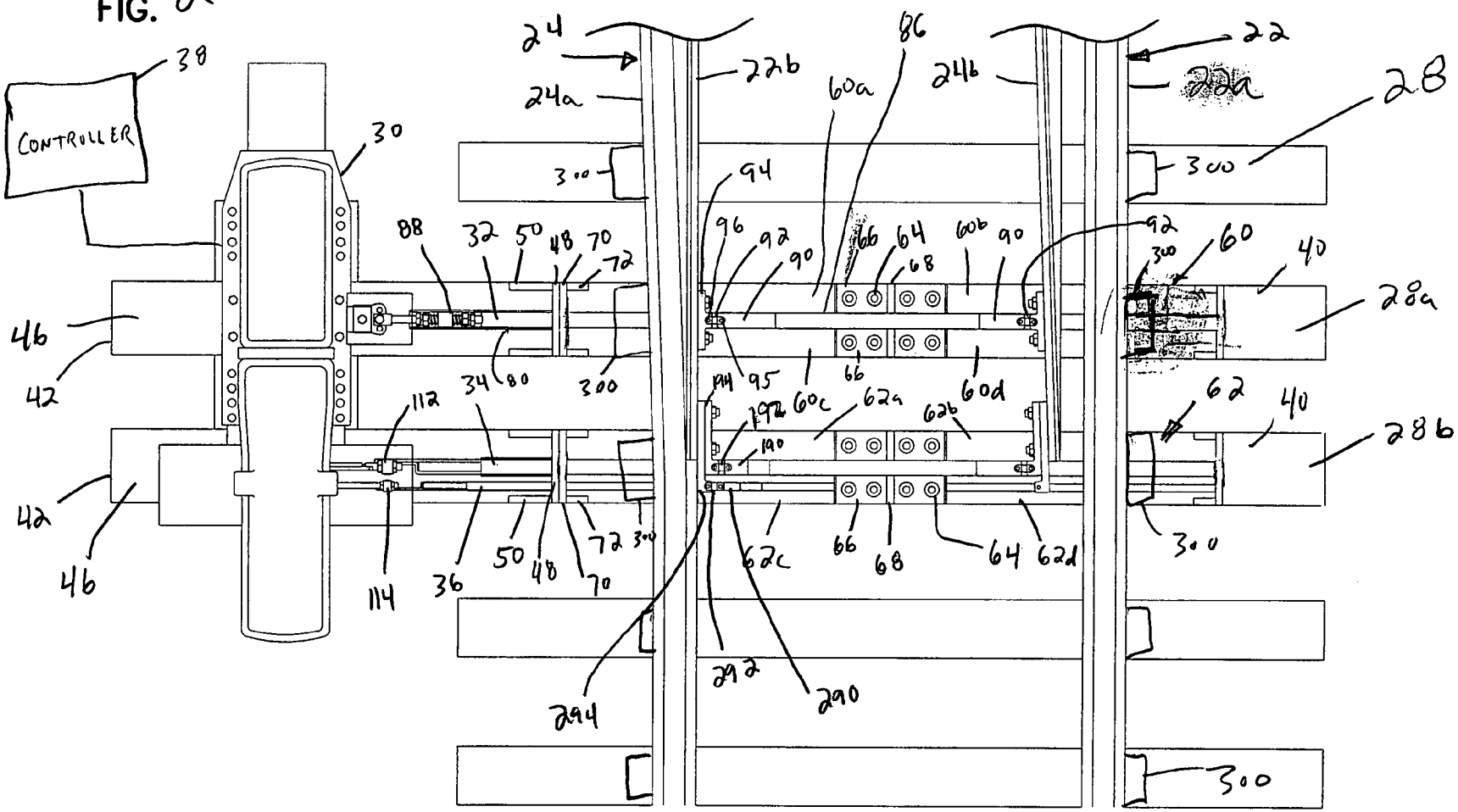
FIG. 7 is a cross-sectional view taken along section line 7-7 of FIG. 6.
Figure 8:
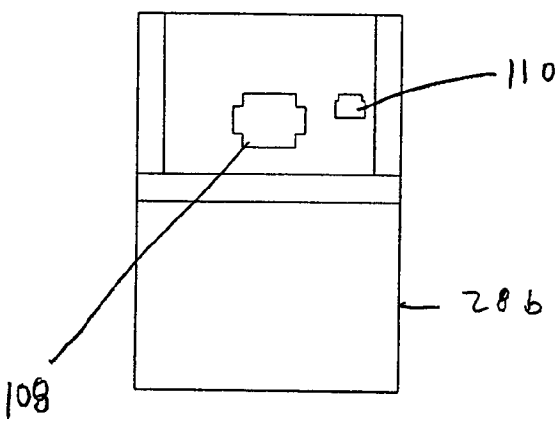
FIG. 8 is a cross-sectional view taken along section line 8-8 of FIG. 6.
Figure 7:
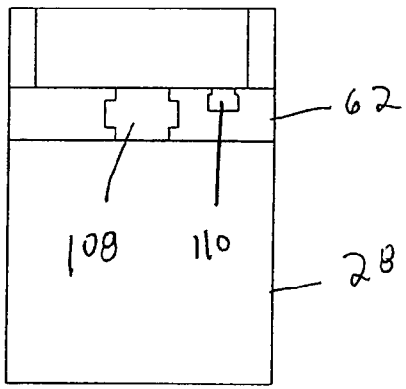

Referring to FIGS. 6-8, the rail support plate 62 defines channels 108, 110 that extend along the length of the plate 62. The channels 108, 110 are adapted for respectively receiving the lock rod 34 and the indication rod 36. The channels 108, 110 guide linear movement of the lock rod 34 and the indication rod 36. The support plate 62 supports the rails and prevents the lock rod 34 and the indication rod 36 from being crushed. The support plate 62 also reinforces the rods 34, 36 along their lengths. In certain embodiments, substantially all of the lengths of the rods 34, 36 between the rails are in contact with the support plate 62. Lock rod 34 is coupled to the actuator 30 at linkage 112 and indication rod 36 is coupled to the actuator 30 at linkage 114. Similar to the throw rod 32, the lock rod 34 and the indication rod 36 extend through the flanges 48, 70 and into the respective channels 108, 110. As shown at FIG. 2, risers 190 and pivot links 192 are used to couple the lock rod 34 to brackets 194 fastened to the switching rails 22*b*, 24*b*. Still referring to FIG. 2, risers 290 and pivot links 292 are also used to couple the indication rod 36 to brackets 294 fastened to the switching rails 22*b*, 24*b*. The pivot links prevent the rods 34, 36 from binding within their respective channels 108, 110 as the switching rails 22*b*, 24*b* are moved between the position of FIG. 1A and the position of FIG. 1B.

It is preferred for the throw rod, the lock rod and the indication rod 36 to each have a construction that does not conduct electricity between the rails 22*a*, 22*b* or between the rails 24*a*, 24*b*. The ability to not conduct electricity is advantageous because trains often include safety circuitry that detects electrical current between the rails. If the rods electrically connect opposite rails, the operation of the safety circuitry could be compromised. In one embodiment, rods 32, 34 and 36 are constructed of a dielectric material such as plastic. In other embodiments, rods can have a composite construction including both conductive and non-conductive materials. In still further embodiments, the rods 32, 34, 36 can have a dielectric coating. In certain embodiments, a layer such as Teflon or other low friction material (e.g., grease) can be provided within the channels or on the rods 32, 34, 36 to facilitate linear movement of the rods within their respective channels.

Since the switching arrangements disclosed herein are mounted on the top sides of railroad ties, the arrangements do not interfere with tamping operations.

In use, the switch rails 22*b*, 24*b* may move in a longitudinal orientation (see orientation arrow 400 at FIG. 1A) when approaches and passes over the rails 22*b*, 24*b*. This is caused by the train pushing the rails as the train approaches the switch point and can be referred to as "running" the rails. In certain cases, the rails 22*b*, 24*b* may move an inch or more in the direction of travel of the train. The switching arrangements of FIGS. 9-12 include structure for accommodating longitudinal movement of the rails 22*b*, 24*b*. In certain embodiments, the structures allow the rails 22*b*, 24*b* to move relative at least 2 inches in the longitudinal direction 400 relative to the throw rod coupled to the rails 22*b*, 24*b*. For example, the rails 22*b*, 24*b* can move at least one inch in each direction along the orientation 400 relative to the central longitudinal axis of the throw rod coupled to the rails 22*b*, 24*b*. It will be appreciated that the same structures for allowing accommodating longitudinal movement of the switching rails relative to the throw rod can also be used in combination with the locking rod and the indicator rod to accommodate longitudinal movement of the switching rails relative to such rods.

Figure 9:
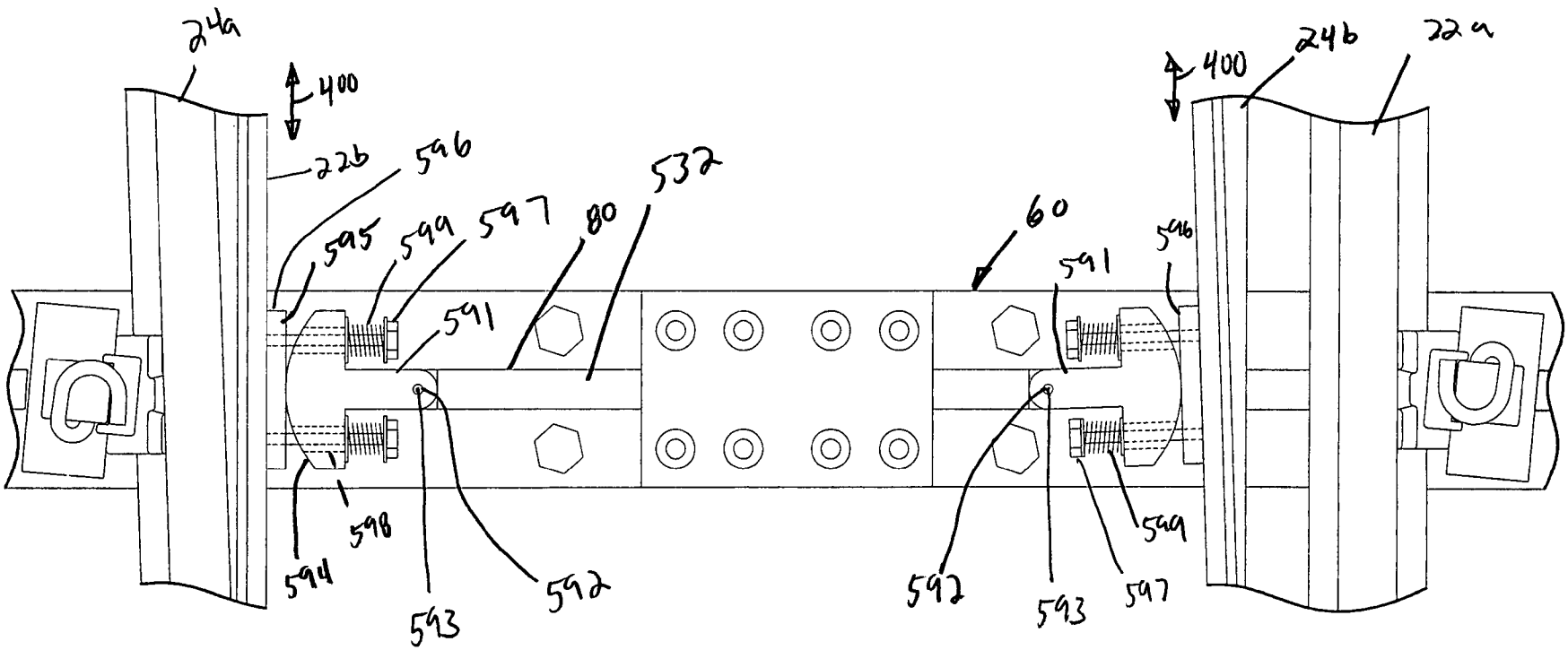
FIG. 9 is a top, plan view of an alternative switch point linkage arrangement in accordance with the principles of the present disclosure, the linkage arrangement is adapted to accommodate longitudinal movement of the switch rails.
Figure 10:
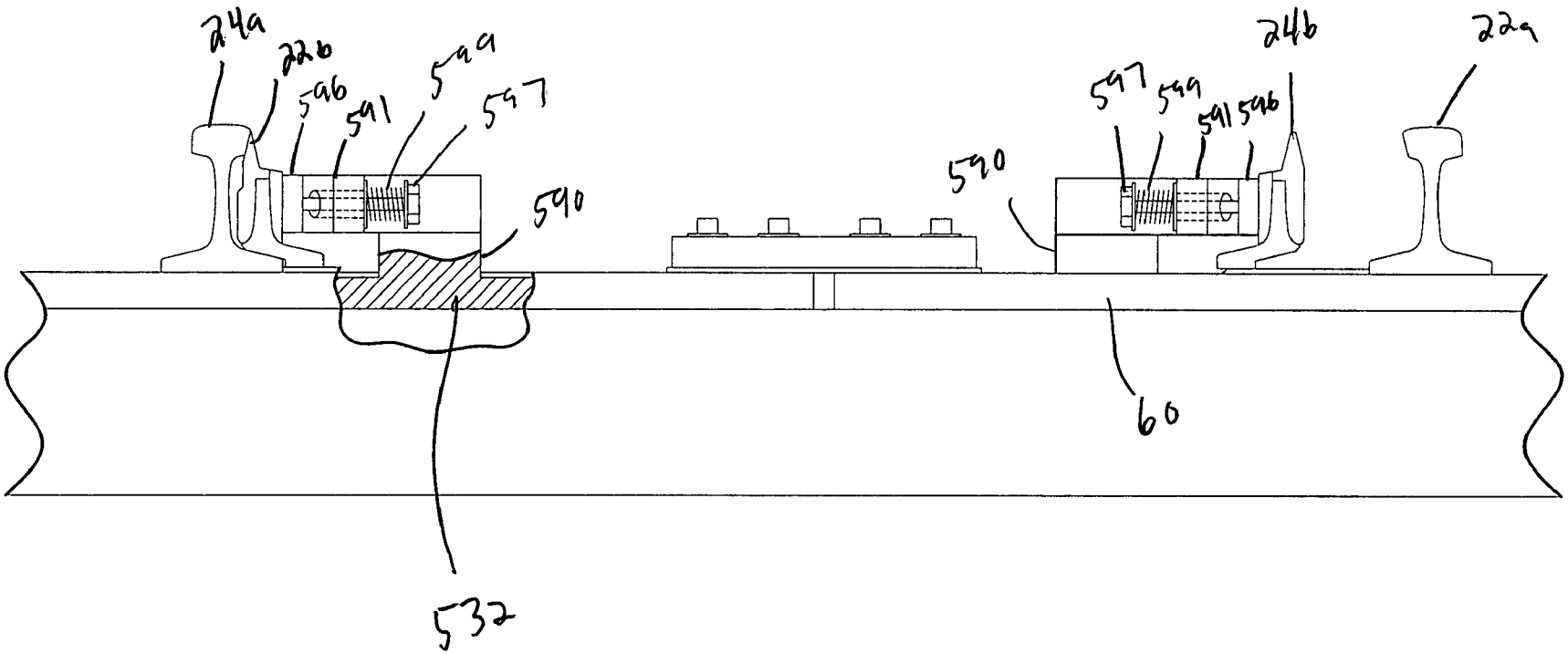
FIG. 10 is a side view of the switch point linage arrangement of FIG. 9.

FIGS. 9 and 10 show a switching arrangement including a throw rod 532. Similar to the previous embodiment, the throw rod 532 is slidably mounted in channel 80 defined by support plate 60, and one end of the throw rod 532 is connected to actuator 30 that controls movement of the throw rod 532 within the channel 80.

The throw rod 532 includes risers 590 that extend upwardly through the open top side of the channel 80. The risers 590 are pivotally connected to rocker members 591 by pivot members 592 (e.g., pins, bolts, rivots, or other fasteners that allow pivotal movement). The rocker members 591 can pivot relative to the throw rod 532 about vertical axes 593 defined through the pivot members 592. The rocker members 591 have curved surfaces 594 that engage planar surfaces 595 of brackets 596 secured (e.g., welded, fastened, or otherwise attached) to the switching rails 22*b*, 24*b*. The planar surfaces 595 are oriented generally perpendicular relative to the longitudinal axis of the throw rod 532. Fasteners 597 (e.g., shoulder bolts) connect the rocker members 591 to the brackets 596. For example, the fasteners 597 extend though holes 598 in the rocker members 591 and are anchored into the brackets 596. Sufficient clearance exists between the holes 598 and the fasteners 597 to allow the rocket members 591 to rock or toggle relative to the brackets 596. When the rocker members 591 rock relative to the brackets 596, the curved surfaces 594 roll along the planar surfaces 595 of the brackets 596. Springs 599 are provided on the fasteners 597 to bias the rocker members 591 to a central position where the central axes of the rocker members 591 are aligned with the longitudinal axis of the throw rod 532.

In use, the rocker members 591 allow the switching rails 22*b*, 24*b* to move in the longitudinal orientation 400 relative to the throw rod 532. For example, as the switching rails 22*b*, 24*b* move along the orientation 400 relative to the throw rod 532, the curved surfaces 594 of the rocker members 591 roll on the planar surfaces 595 of the brackets 596 and the rocker members 591 simultanteously pivot about the pivot axes 593 relative to the throw rod 532 to accommodate the longitudinal movement of the rails 22*b*, 24*b*. The rocker members 591 can pivot in either clockwise or counterclockwise directions about the axes 593 and the rocker members 591 can rock forward or backward to accommodate rail movement in either a forward or backward direction along the longitudinal orientation 400.

To move the rails 22*b*, 24*b* to a position where rail 22*b* engages rail 24*a* (see FIG. 9), the actuator 30 pushes the throw rod 532 along the longitudinal axis of the throw rod 532 in a direction away from the actuator 30. As the throw rod is pushed, force is transferred to the rail 22*b* by direct contact between the curved surface 594 of the rocker member 591 and the planar surface 595 of the bracket 596 attached to the rail 22*b*, and force is transferred to rail 24*b* through the fasteners 597. To move the rails 22*b*, 24*b* to a position where rail 24*b* engages rail 22*a*, the actuator 30 pulls the throw rod 532 along the longitudinal axis of the throw rod 532 in a direction toward the actuator 30. As the throw rod is pulled, force is transferred to the rail 24*b* by direct contact between the curved surface 594 of the rocker member 591 and the planar surface 595 of the bracket 596 attached to the rail 24*b*, and force is transferred to rail 22*b* through the fasteners 597.

Figure 11:
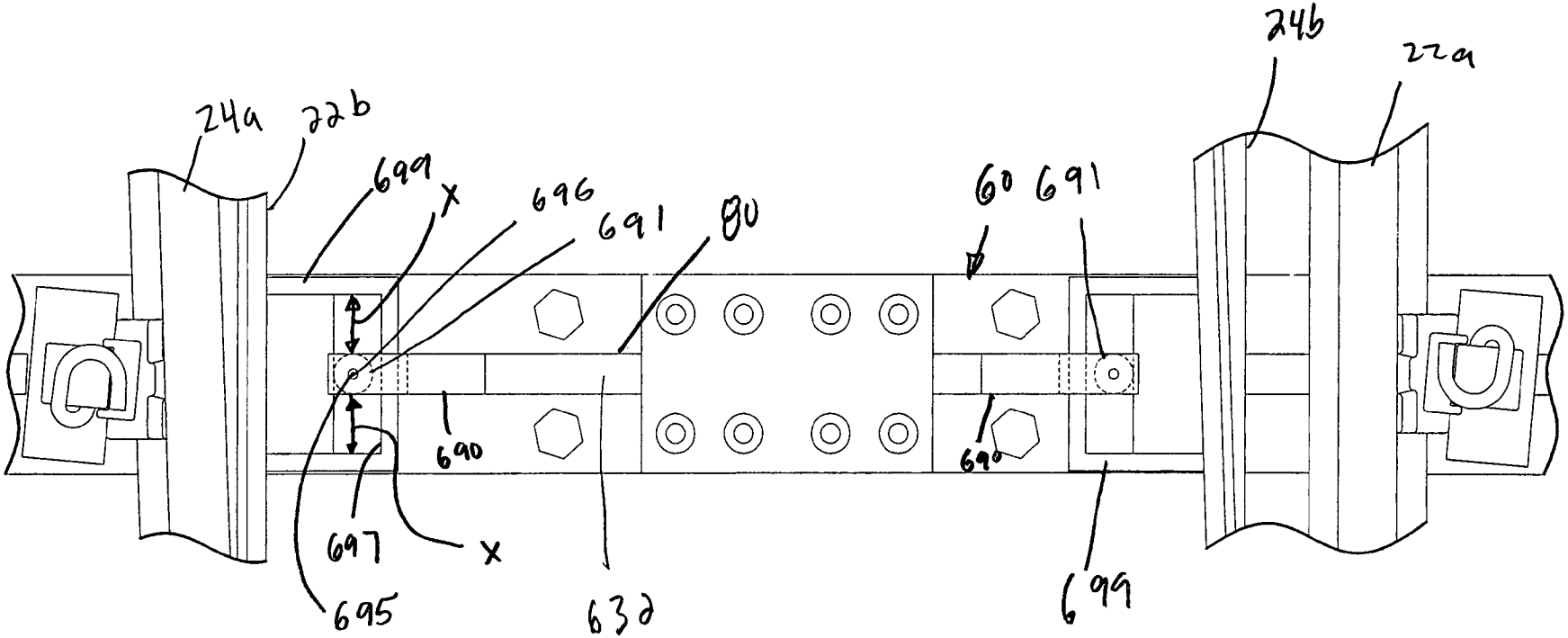
FIG. 11 is a top, plan view of a further switch point linkage arrangement in accordance with the principles of the present disclosure, the linkage arrangement is also adapted to accommodate longitudinal movement of the switch rails.
Figure 12:
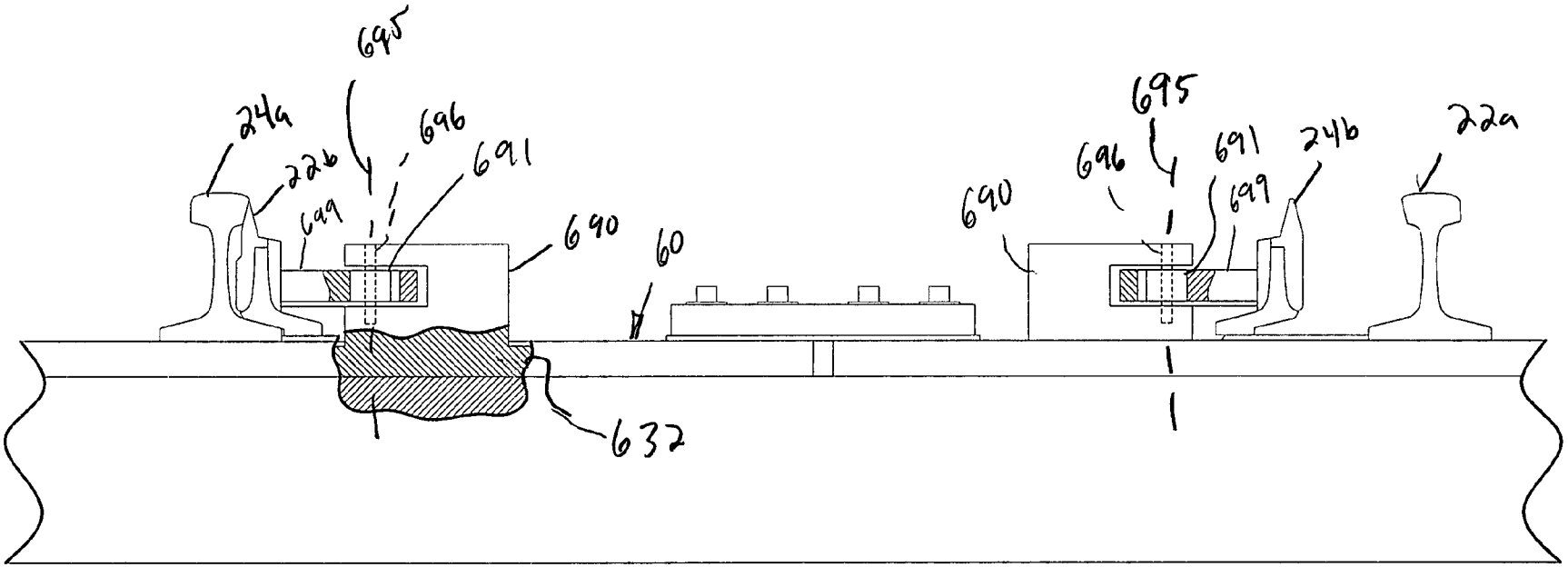
FIG. 12 is a side view of the switch point linkage arrangement of FIG. 11.
Figure 1A:
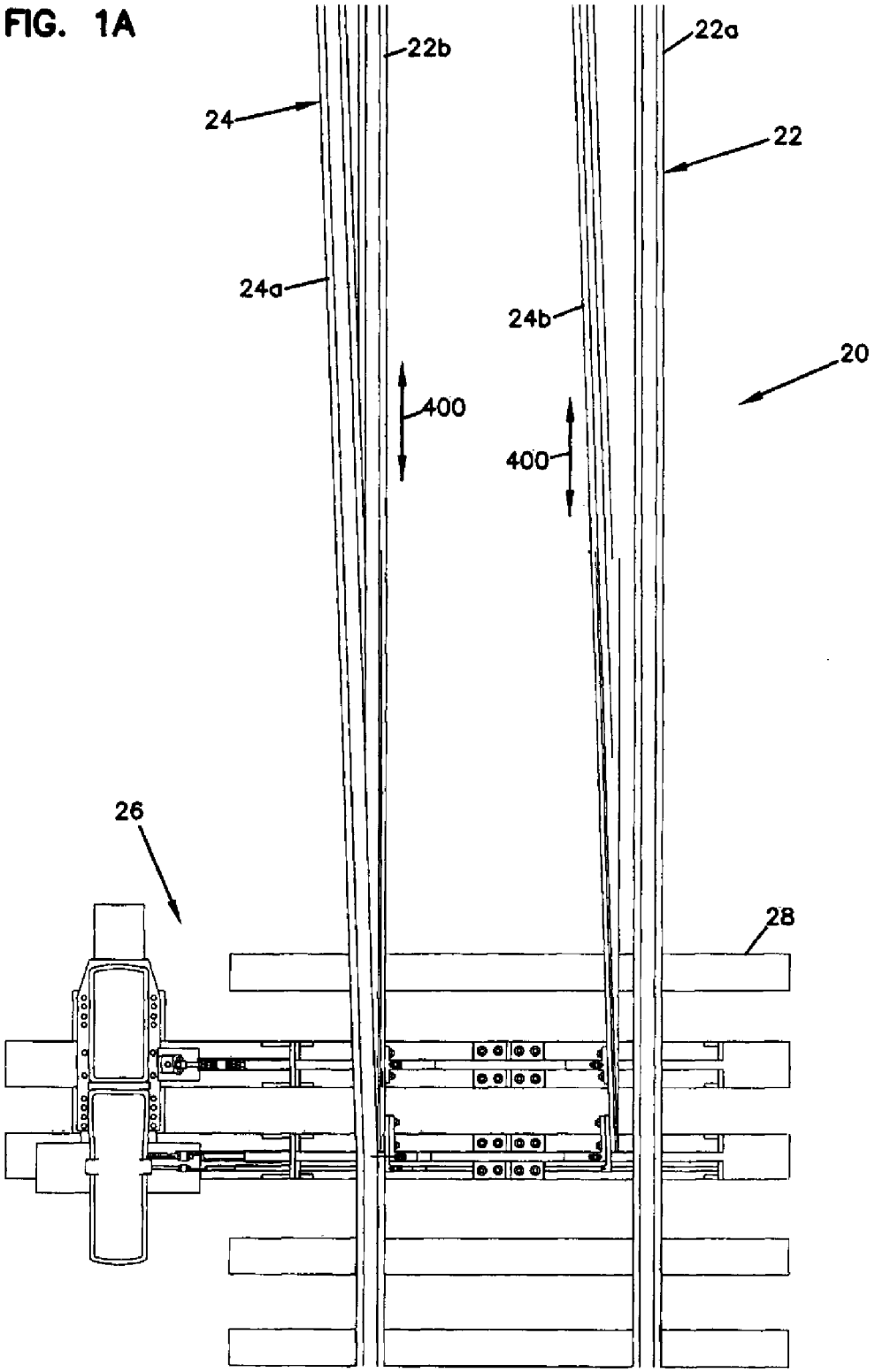
Figure 1B:
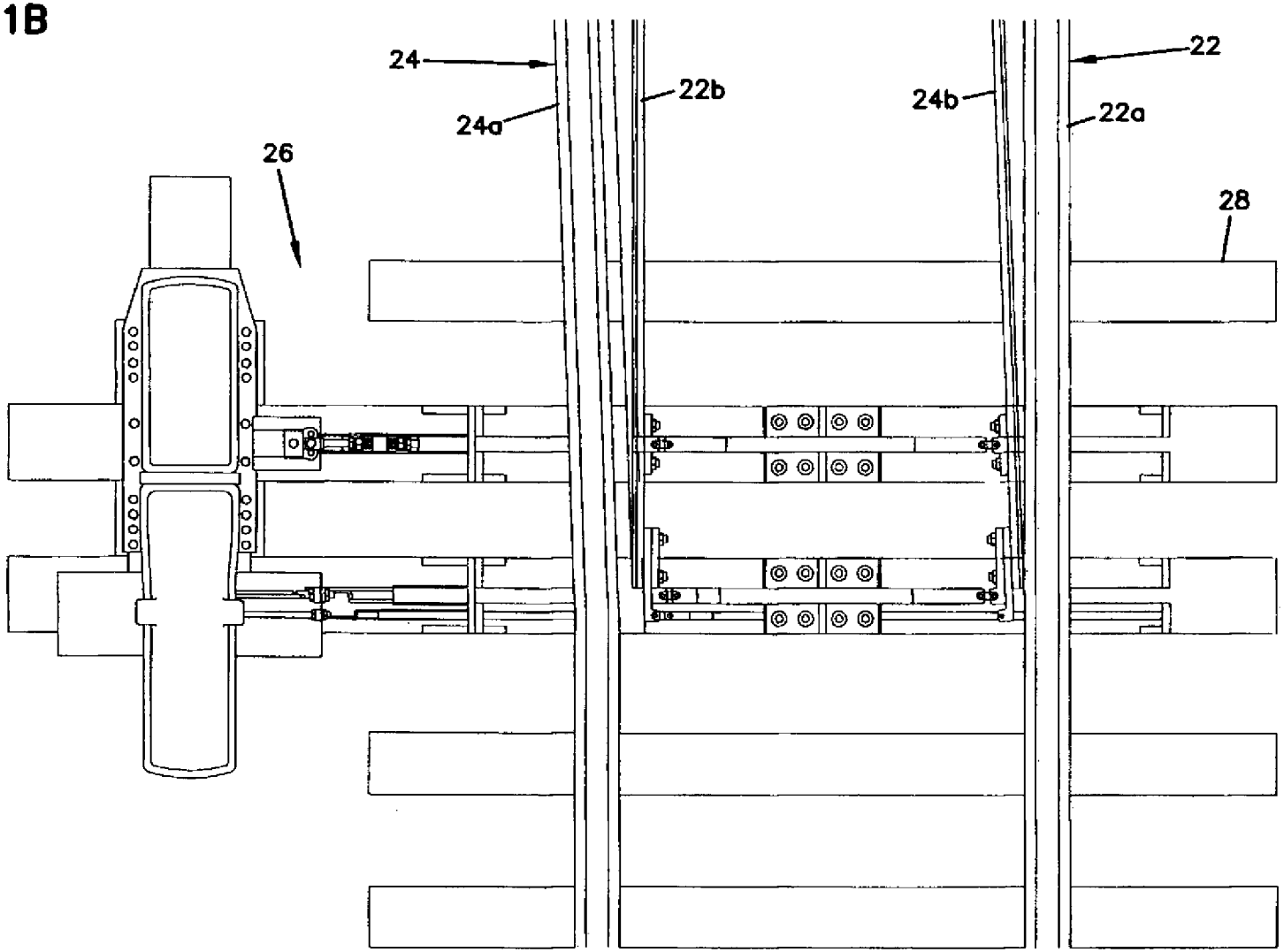

FIGS. 11 and 12 show a switching arrangement including a throw rod 632. Similar to the previous embodiments, the throw rod 632 is slidably mounted in channel 80 defined by support plate 60, and one end of the throw rod 632 is connected to actuator 30 that controls movement of the throw rod 632 within the channel 80.

The throw rod 632 includes risers 690 that extend upwardly through the open top side of the channel 80. The risers 690 are connected to members 691. As depicted in FIGS. 11 and 12, the members 691 are rollers (e.g., roller bearings) that are free to rotate about vertical pivot axes 695 defined by pins 696 connected to the risers 690. The members 691 fit within slots/tracks 697 defined by members 699 secured to the rails 22*b*, 24*b*. The slots/tracks 697 are aligned generally perpendicular to the longitudinal axis of the throw rod 632.

In use, the members 691, 699 allow the switching rails 22*b*, 24*b* to move in the longitudinal orientation 400 relative to the throw rod 632. For example, as the switching rails 22*b*, 24*b* move along the orientation 400 relative to the throw rod 632, the members 699 move/slide relative to the members 691 in a direction perpendicular to the longitudinal axis of the throw rod 632. The lengths of the slots/tracks 697 provide space to accommodate this relative movement. The members 691 are typically centered with the slots/tracks 697 when the switching rails are in their normal position. Thus, the members 699 can move a distance x in a forward direction relative to the members 691 to accommodate rail movement in the forward direction, and can also move a distance x in a backward direction relative to the members 691 to accommodate rail movement is a backward direction. In one embodiment, the distance x is at least 0.5 inches. In another embodiment, the distance x is at least 0.75 inches. In still another embodiment, the distance x is at least 1 inch.

To move the rails 22*b*, 24*b* to a position where rail 22*b* engages rail 24*a* (see FIG. 11), the actuator 30 pushes the throw rod 632 along the longitudinal axis of the throw rod 532 in a direction away from the actuator 30. As the throw rod 632 is pushed, force is transferred to the rails 22*b*, 24*b* through the slide members 691 which engage the guide members 699 secured to the rails 22*b*, 24*b*. To move the rails 22*b*, 24*b* to a position where rail 24*b* engages rail 22*a*, the actuator 30 pulls the throw rod 632 along the longitudinal axis of the throw rod 532 in a direction toward the actuator 30. As the throw rod is pulled, force is transferred to the rails 22*b*, 24*b* through the slide members 691 which engage the guide members 699 secured to the rails 22*b*, 24*b*.

The above specification provides examples of how certain inventive aspects may be put into practice. It will be appreciated that the inventive aspects can be practiced in other ways than those specifically shown and described herein without departing from the spirit and scope of the inventive aspects. The description, like reference numbers have been used to identify like or similar parts.

What is claimed is:

1. A railroad track switching device comprising:

a railroad tie having a top side;

a plate arrangement secured to the top side of the railroad tie, the plate arrangement defining a channel that extends along a length of the railroad tie; the channel being located above the top side of the railroad tie;

a rod slidably mounted within the channel defined by the plate arrangement; and wherein the railroad tie includes a track supporting portion and an actuator supporting portion, the track supporting portion having a greater height than the actuator supporting portion.

2. The railroad track switching device of claim 1, wherein the rod is adapted to not conduct electricity between railroad rails.

3. The railroad track switching device of claim 1, wherein the rod has a dielectric construction.

4. The railroad track switching device of claim 3, wherein the rod is made of a plastic material.

5. The railroad track switching device of claim 1, wherein the channel includes interior notches that extend along a length of the channel, wherein the rod includes projections that extend along a length of the rod, and wherein the projections of the rod fit within the interior notches of the channel.

6. The railroad track switching device of claim 1, wherein the railroad tie has a generally nine inch square transverse cross section at a location beneath the plate arrangement.

7. The railroad track switching device of claim 1, wherein the railroad tie has a wood construction.

8. The railroad track switching device of claim 1, wherein the rod is adapted for connection to a switch actuator, and the rod is also adapted for connection to a pair of switching rails.

9. The railroad track switching device of claim 1, wherein the channel has an open top, and the rod includes portions that project upwardly through the open top of the channel.

10. The railroad track switching device of claim 1, wherein the rod includes a connection interface for connecting the rod to switch rails, the connection interface being configured to allow movement of the rails in a direction perpendicular to a longitudinal axis of the rod.

11. The railroad track switching device of claim 10, wherein the connection interface provides the rails with a range of movement of at least 1 inch in the direction perpendicular to the longitudinal axis of the rod.

12. The railroad track switching device of claim 10, wherein the connection interface includes a rocker member pivotally connected to the rod, the rocker member having a curved surface configured for allowing the rocker member to rock relative to one of the switch rails to accommodate movement of the rail in the direction perpendicular to the longitudinal axis of the rod.

13. The railroad track switching device of claim 10, wherein the connection interface includes a first member adapted to be carried by one of the switch rails and a second member carried by the rod, the first member defining a slot adapted to align generally perpendicular to the longitudinal axis of the rod, the second member adapted to fit within the slot.

14. A railroad track switching device comprising:

a railroad tie having a top side;

a plate arrangement secured to the top side of the railroad tie, the plate arrangement defining first and second channels that extend along a length of the railroad tie; the first and second channels being located above the top side of the railroad tie;

a first rod slidably mounted within the first channel defined by the plate arrangement; and a second rod slidably mounted within the second channel defined by the plate arrangement.

15. A railroad switch point having fixed rails and switching rails, the railroad switch point comprising:

a first railroad tie having a top side;

a throw rod positioned at the top side of the first railroad tie, the throw rod being coupled to the switching rails;

an actuator for moving the throw rod to change a switch position of the switching rails; and a first rail support secured to the top side of the first railroad tie for supporting the fixed rails and the switching rails above the throw rod;

wherein the first rail support includes a plate arrangement that defines a channel in which the throw rod is slidably received.

16. The railroad switch point of claim 15, wherein the plate arrangement includes sets of plates that are electrically isolated from one another.

17. The railroad switch point of claim 16, wherein the throw rod has a dielectric construction.

18. The railroad switch point of claim 15, further comprising:

a second railroad tie having a top side;

a locking rod positioned at the top side of the second railroad tie, the locking rod being coupled to the switching rails and coupled to the actuator;

an indicator rod positioned at the top side of the second railroad tie, the indicator rod being coupled to the switching rails and coupled to the actuator;

a second rail support secured to the top side of the second railroad tie for supporting the fixed rails and the switching rails above the locking rod and the indicator rod.

19. A railroad track switching device comprising:

a railroad tie having a top side;

a plate arrangement secured to the top side of the railroad tie, the plate arrangement defining a channel that extends along a length of the railroad tie; the channel being located above the top side of the railroad tie, wherein the channel includes interior notches that extend along a length of the channel, wherein the rod includes projections that extend along a length of the rod, and wherein the projections of the rod fit within the interior notches of the channel; and a rod slidably mounted within the channel defined by the plate arrangement.

20. A railroad track switching device comprising:

a railroad tie having a top side;

a plate arrangement secured to the top side of the railroad tie, the plate arrangement defining a channel that extends along a length of the railroad tie; the channel being located above the top side of the railroad tie, wherein the channel has an open top, and the rod includes portions that project upwardly through the open top of the channel; and a rod slidably mounted within the channel defined by the plate arrangement.

* * * * *

UNITED STATES PATENT AND TRADEMARK OFFICE

CERTIFICATE OF CORRECTION

PATENT NO. : 7,530,535 B2
APPLICATION NO. : 11/521081
DATED : May 12, 2009
INVENTOR(S) : David K. Fox It is certified that error appears in the above-identified patent and that said Letters Patent is hereby corrected as shown below:

On title page showing an illustrative figure, should be deleted and substitute therefore the attached title page.

Delete drawings sheets 1-11 and substitute therefore the drawing sheets consisting of Fig. 1-12, as shown on the attached pages.

Signed and Sealed this

Nineteenth Day of January, 2010

David J. Kappos

David J. Kappos
*Director of the United States Patent and Trademark Office*

(12) United States Patent
Fox

(10) Patent No.: US 7,530,535 B2
(45) Date of Patent: May 12, 2009

(54) RAILWAY TRACK SWITCH

(76) Inventor: David K. Fox, 440 W. Ferndale Rd., Wayzata, MN (US) 55391

( * ) Notice: Subject to any disclaimer, the term of this patent is extended or adjusted under 35 U.S.C. 154(b) by 110 days.

(21) Appl. No.: 11/521,081

(22) Filed: Sep. 13, 2006

(65) Prior Publication Data

US 2007/0080263 A1 Apr. 12, 2007

Related U.S. Application Data

(60) Provisional application No. 60/716,766, filed on Sep. 13, 2005.

(51) Int. Cl.
*E01B 7/00* (2006.01)

(52) U.S. Cl. ..... 246/452; 246/453; 246/415 R

(58) Field of Classification Search ..... 246/393, 246/415 R, 430, 431, 435 R, 442, 448, 449, 246/450, 451, 452, 453, 476
See application file for complete search history.

(56) References Cited

U.S. PATENT DOCUMENTS

| | | | | | |
|---|---|---|---|---|---|
| 71,807 | A | | 12/1867 | Staats | |
| 248,990 | A | * | 11/1881 | Brahn | 246/321 |
| 1,348,729 | A | * | 8/1920 | Myers | 246/337 |
| 1,430,952 | A | * | 10/1922 | Crossley | 246/318 |
| 1,802,875 | A | | 4/1931 | Conley | |
| 2,651,714 | A | * | 9/1953 | Poole | 246/253 |
| 4,093,163 | A | | 6/1978 | Larsson | |
| 4,105,175 | A | | 8/1978 | De Spiegeleer | |
| 4,890,804 | A | | 1/1990 | Teramoto et al. | |
| 5,562,267 | A | | 10/1996 | Heim et al. | |
| 5,620,156 | A | | 4/1997 | Berggren et al. | |
| 5,622,340 | A | | 4/1997 | Turner et al. | |
| 6,158,698 | A | | 12/2000 | Click et al. | |
| 6,290,189 | B1 | | 9/2001 | Heim | |
| 6,511,024 | B1 | | 1/2003 | Bonfigli | |
| 6,543,727 | B2 | | 4/2003 | Click et al. | |
| 2004/0227037 | A1 | | 11/2004 | Schwiede et al. | |

OTHER PUBLICATIONS

International Search Report and Written Opinion mailed Jun. 26, 2008.

* cited by examiner

*Primary Examiner*—Mark T Le
(74) *Attorney, Agent, or Firm*—Merchant & Gould P.C.

(57) ABSTRACT

A railroad switch point having fixed rails and switching rails is provided. The switch point includes a first railroad tie having a top side. The switch point also includes a rod positioned at the top side of the first railroad tie. The rod is coupled to the switching rails and is also coupled to a switch actuator. A first rail support is secured to the top side of the first railroad tie for supporting the fixed rails and the switching rails above the rod.

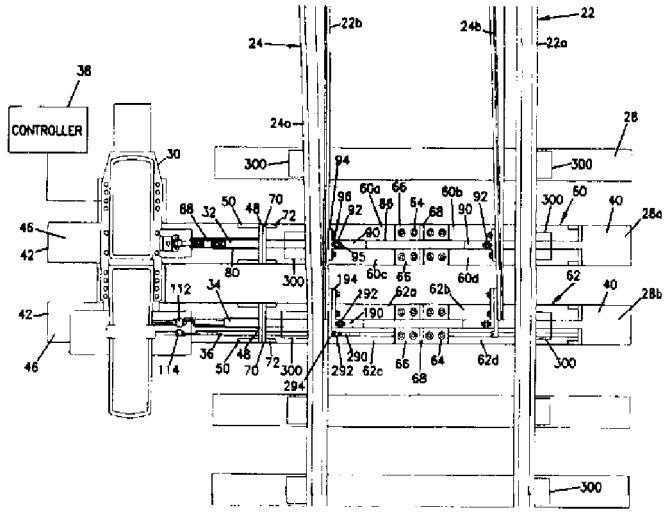

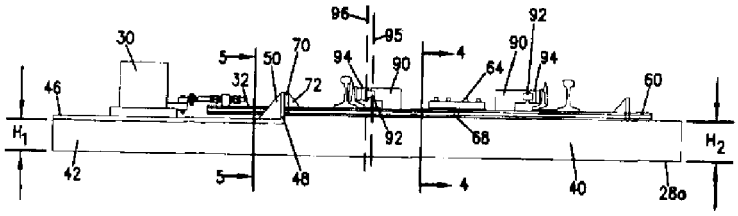

20 Claims, 11 Drawing Sheets